US005862686A

United States Patent [19]

Skrippek

[11] Patent Number: 5,862,686

[45] Date of Patent: Jan. 26, 1999

[54] DRIVE DEVICE FOR A FRONT-LOADING WASHING MACHINE

[75] Inventor: Jörg Skrippek, Priort, Germany

[73] Assignee: BSH Bosh und Siemens Hausgeraete GmbH, Munich, Germany

[21] Appl. No.: 767,956

[22] Filed: Dec. 19, 1996

[30] Foreign Application Priority Data

Dec. 20, 1995 [DE] Germany ..... 195 47 745.6

[51] Int. Cl.[6] ..... D06F 37/30

[52] U.S. Cl. ..... 68/140

[58] Field of Search ..... 68/12.16, 24, 140

[56] References Cited

U.S. PATENT DOCUMENTS 4,446,706 5/1984 Hartwig ..... 68/24

FOREIGN PATENT DOCUMENTS 1354594 1/1964 France ..... 68/24
4157 7/1956 Germany ..... 68/24
6411595 4/1965 Netherlands ..... 68/140

*Primary Examiner*—Philip R. Coe
*Attorney, Agent, or Firm*—Herbert L. Lerner; Laurence A. Greenberg

[57] ABSTRACT

A drive device for a front-loading washing machine having a washing liquid-container with a rear wall, an at least substantially horizontal shaft having an outer end, and a laundry drum supported overhung on the shaft, includes a flat motor mounted at the rear wall of the washing liquid container for directly driving the shaft. The flat motor has a stator connected to the rear wall of the washing liquid container or to a stiff carrier part mounted at the rear wall of the washing liquid container. The stator has a central bearing sleeve for the shaft. The flat motor has a rotor with a peripheral portion, a bell-like flange at the peripheral portion facing the washing liquid container, a hub centrally fastened to and encompassing the outer end of the shaft, a plurality of openings between the hub and the peripheral portion, magnetizable poles distributed at the inner periphery of the bell-shaped flange, lamination stacks distributed at the stator and disposed opposite to and spaced apart from the rotor defining a minimum air gap, and exciter windings received by the lamination stacks.

7 Claims, 2 Drawing Sheets

DRIVE DEVICE FOR A FRONT-LOADING WASHING MACHINE

BACKGROUND OF THE INVENTION

FIELD OF THE INVENTION

The invention relates to a drive device for a front-loading washing machine having a laundry drum which is supported overhung by an at least substantially horizontal shaft within a bearing sleeve of a stiff carrier part mounted at a rear-wall of a washing liquid container, which is driven directly by a flat motor that is likewise mounted at the rear wall of the washing liquid container.

Such drive devices are known from German Published, Non-Prosecuted Patent Applications DE 39 27 426 A1 and the DE 43 41 832 A1. In those devices, the stator of the motor which is constructed as a collectorless external rotor direct current motor, is fastened directly on the bearing sleeve of the stiff carrier part. The shaft is supported in the bearing sleeve and connected at its outer end with the rotor of the motor so as to be secure against rotation. The rotor therein is a so-called external rotor which engages over the stator windings like a pot and carries poles constructed as permanent magnets. In automatic washing machines according to German Published, Non-Prosecuted Patent Application DE 43 41 832 A1, the motor is additionally surrounded by an insulating rod which attenuates noises radiated directly from the motor to the surrounding atmosphere.

In the known drive devices, the stator is exposed to an appreciable temperature loading in its windings due to heat flow. The stator is encapsulated by a rotor having a pot-shaped structure (and additionally by a sound-insulating hood in the case of German Published, Non-Prosecuted Patent Application DE 43 41 832 A1) so strongly that cooling of the motor does not take place at all. That is also enhanced above all by a direct driving motor of the type that is hardly able to reach self-cooling by virtue of the self-rotating rotor, because of its necessarily low inherent rpm. Therefore, the known drive devices are practically only usable when they are protected against rapid overheating by external cooling.

Beyond that, the known drive devices cannot be delivered to the washing machine manufacturing plant as an already assembled motor. The stators and rotors thereof must be delivered separately and only be assembled with each other in the washing machine plant. Since special assembly equipment for the completion of motor assemblies as a rule is not present in a washing machine plant and is also not desired, the completion of the stator assembly to be connected with the liquid container system by the external rotor assembly as a rule can only take place inaccurately. Since extremely high demands are made on the maintenance of a small air gap, which as far as possible is always equally great for each product, wherein the air gap is between the stator poles and the rotor poles as well as on the centered bearing, and those demands are not to be fulfilled in the aforementioned assembly in a washing machine factory, the known drive devices are practically only very conditionally usable.

SUMMARY OF THE INVENTION

It is accordingly an object of the invention to provide a drive device for a front-loading washing machine, which overcomes the hereinafore-mentioned disadvantages of the heretofore-known devices of this general type, in which on one hand a cooling of the stator windings by the ambient air can be readily assured and the motor cannot overheat during orderly operation with dimensions that meet demands, and in which on the other hand the motor can be completed and tested in the motor manufacturing plant before it is to be built-in by a washing machine manufacturer.

With the foregoing and other objects in view there is provided, in accordance with the invention, in a front-loading washing machine having a washing liquid-container with a rear wall, an at least substantially horizontal shaft having an outer end, and a laundry drum supported overhung on the shaft, a drive device, comprising a flat motor mounted at the rear wall of the washing liquid container for directly driving the shaft, the flat motor having a stator connected to the rear wall of the washing liquid container directly or by a stiff carrier part mounted at the rear wall of the washing liquid container, the stator having a central bearing sleeve for the shaft, and the flat motor having a rotor with a peripheral portion, a bell-like flange at the peripheral portion facing the washing liquid container, a hub centrally fastened to and encompassing the outer end of the shaft, a plurality of openings between the hub and the peripheral portion, magnetizable poles distributed at the inner periphery of the bell-shaped flange, lamination stacks distributed at the stator and disposed opposite to and spaced apart from the rotor defining a minimum air gap, and exciter windings received by the lamination stacks.

Due to the structure according to the invention, the motor has an open form of construction and has heat-generating components, above all the stator windings, that can be cooled by the ambient air from all sides. Even the low rotational speed of the motor during the washing operation then still suffices for the rotor to produce a heat-removing air movement.

In this manner, the motor can be assembled and tested completely in the manufacturing plant of the motor supplier. The assembly aids and the test aids suitable therefor are available there so that always equally accurately assembled motor assemblies can be supplied to the washing machine plant. In this case, this assembly can be mounted to the rear wall of the washing liquid container system, in place of a cast carrying spider that is usual at this location or additionally thereto. For this purpose, the stator of the complete motor is fastened through the use of several screws at any suitable locations of the rear wall of the washing liquid container. Then, the shaft of the laundry drum is inserted from the front into the hub of the rotor, which is already connected with the stator by way of rolling bearings, and secured from the rear by a central screw. These operating steps are extremely similar to those of the fastening of a carrying spider and a belt pulley according to the heretofore conventional washing machine constructions, so that no completely different working steps have to be learned by the assembly personnel.

In accordance with another feature of the invention, when parts of the rotor are constructed, for enhancement of an air movement arising during its rotational movement, the rotor can produce sufficient cooling air for the stator windings even at low rotational movement, for example at the rotational speed for washing. For this purpose, one can, for example, resort to a spoke-like shaping of the stator disc and a fan-like construction of these spokes.

In accordance with a further feature of the invention, the motor is an electronically commutated direct current motor and the heat development can additionally be kept extremely small. Maintenance operations are not required (no carbon brushes). The service life is limited merely by an eventual bearing wear.

In accordance with an added feature of the invention, the rotor is constructed at least partially of an annular stack of dynamo iron sheets and permanent magnet segments disposed thereon. The permanent magnet segments result in a forceful torque and the dynamo iron sheets form a particularly good magnetic return flux. The production of the required lamination stacks is relative uncomplicated and favorable in terms of costs due to automation of the stacking process.

In accordance with an additional feature of the invention, the pole stacks of the stator are formed of dynamo iron sheets and carry coils with the exciter windings.

In accordance with yet another feature of the invention, in order to facilitate reproducibly accurate assembly, the centered connection of the stator so as to be secure against relative rotation at the shaft can be augmented by a form-locking profiled shaft connection, profiled hub connection, fitted key connection, conical groove connection or keyway connection. A form-locking connection is one which connects two elements together due to the shape of the elements themselves, as opposed to a force-locking connection, which locks the elements together by force external to the elements.

In accordance with a concomitant feature of the invention, the motor is constructed as so-called switched reluctance motor. In this case, the stator is formed of a ferromagnetically relatively poorly conducting material. The build-up of the stator is comparable with that of the electronically commutated direct current motor. The advantage is in particular a construction of the rotor at more favorable costs (no expensive magnetic materials).

Other features which are considered as characteristic for the invention are set forth in the appended claims.

Although the invention is illustrated and described herein as embodied in a drive device for a front-loading washing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
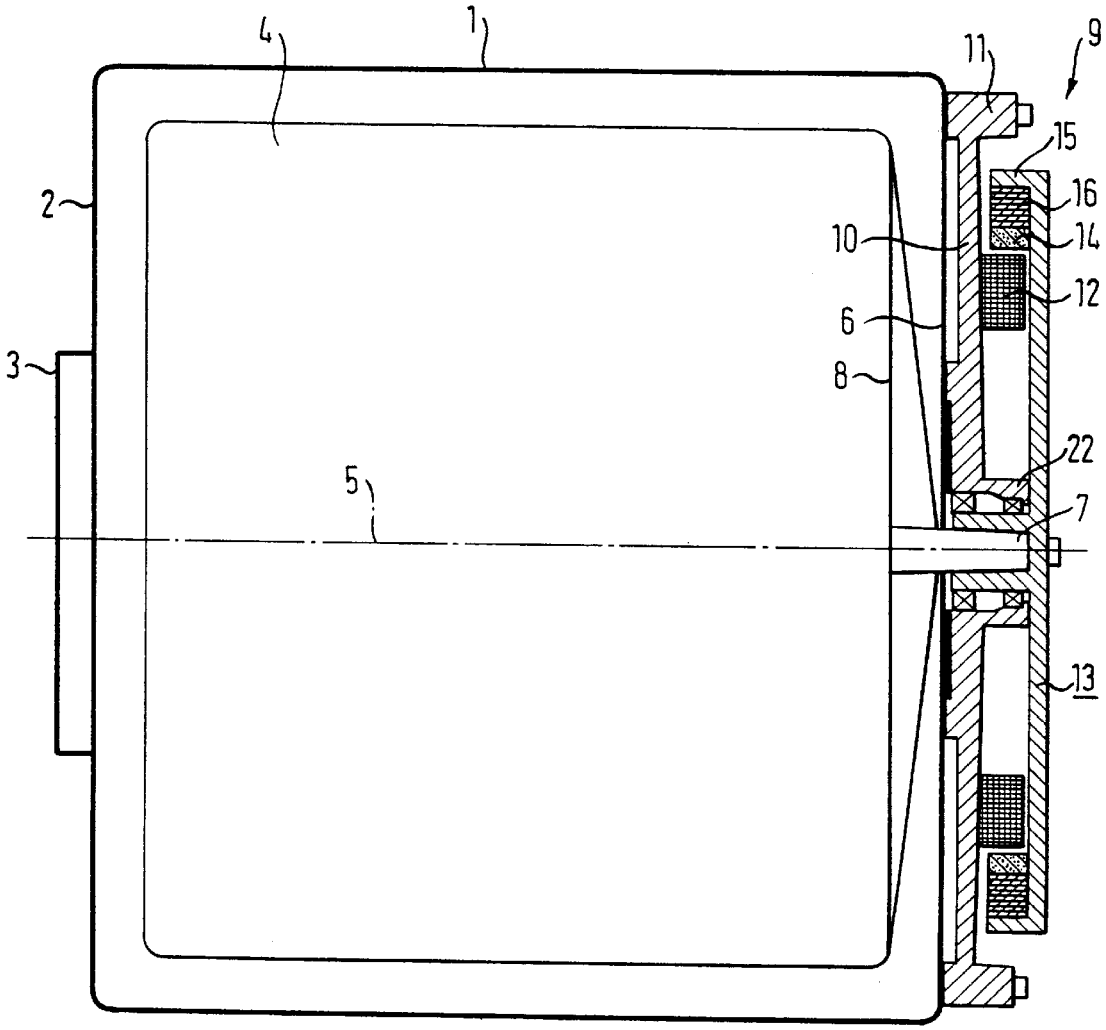
FIG. 1 is a diagrammatic, side-elevational view of a washing liquid container of a washing machine with an internal, horizontally-supported laundry drum having a drive shaft which is supported together with a hub of a stator bell in a bearing sleeve of the stator.

Referring now to the figures of the drawings in detail and first, particularly, to FIG. 1 thereof, there is seen a washing liquid container 1 that is supported overhung in a non-illustrated manner in a likewise non-illustrated housing of a washing machine. The washing liquid container 1 has a front wall 2 with an opening 3 for the loading and unloading of a laundry drum 4, which is supported on a rear wall 6 of the washing liquid container 1 in such a way as to be rotatable about a horizontal axis 5. A shaft 7, which is connected with a rear wall 8 of the laundry drum 4 so as to be secure against relative rotation, serves to support the laundry drum 4.

A motor 9 is mounted at the rear wall 6 of the washing liquid container 1 and has a stator support part 10 which is connected with the rear wall 6 by way of a flange 11 so as to be secure against relative rotation. Several stator windings 12 are distributed at a rearward surface of the stator support part 10 and during rotation of a rotor 13 correspond in alternation with poles 14, which in this case are formed of permanent magnets and are likewise distributed in the manner of segments about the circumference of the rotor 13. A magnetic return flux of the magnet segments 14 is formed by a stack of dynamo iron sheets 16, which lies in a bell flange 15. The motor can thereby introduce its driving torque directly by way of a journal of the shaft 7 into the laundry drum 4. In this case, the stator 10 of the motor takes up all bearing forces, like a carrying spider that is replaced by it.

Figure 2:
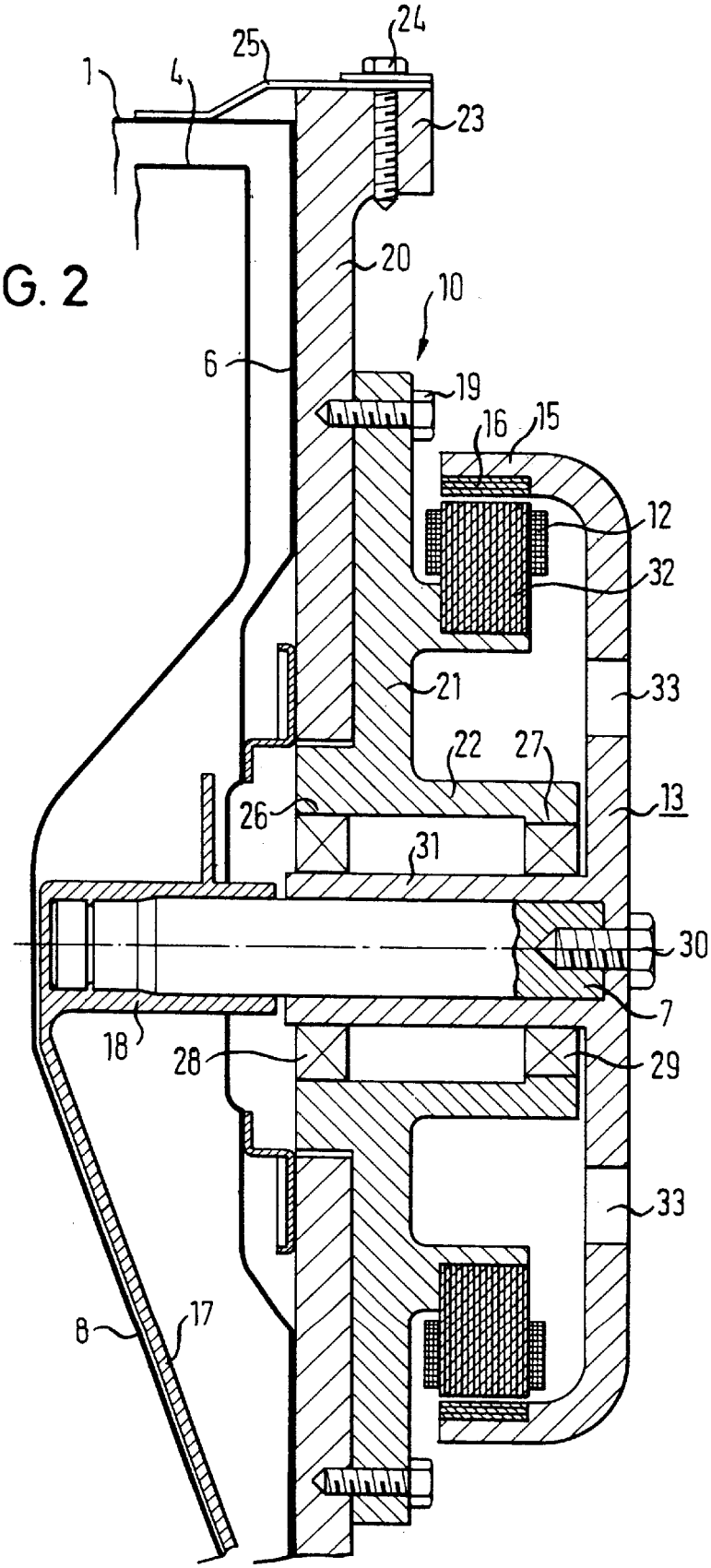
FIG. 2 is an enlarged, fragmentary, partly-sectional view of a motor according to FIG. 1 which is mounted at a rear wall.

According to FIG. 2, the rear wall 8 of the laundry drum 4 is stiffened by a carrying spider 17 having a hub 18 which is connected with the journal of the shaft 7 so as to be secure against relative rotation. The stator support part 10 has an outer periphery carrying several and preferably three fastening eyes 23, which are distributed over the circumference of the washing liquid container 1 and through the use of screws 24 result in a firm connection with the washing liquid container 1 by way of straps 25 welded to the washing liquid container 1. The stator support part 10 is screwed to an assembly disc 20 by screws 19, and the assembly disc 20 in turn is screwed together with the washing liquid container 1 at the rear wall 6 by screws 24. As opposed to this example, the stator support part 10 together with the assembly disc 20 can be constructed in one piece. Then, the separate screw fastening of the bearing part 21 for the stator poles (including the windings 12 and lamination stacks 32) with the assembly disc 20 would become superfluous.

A bearing sleeve 22 of the stator support part 10 forms bearing seats 26 and 27 for rolling bearings 28 and 29, inner rings of which are inserted with a good fit onto the journal of the shaft 7 of the laundry drum 4. An outer end of the shaft 7 is inserted into a hub 31 of the rotor 13 and secured through the use of a central screw 30 so that it connects the rotor 13 by way of its hub 31 and the inner rings of the rolling bearings 28 and 29 of the laundry drum 4 so as to be secure against relative rotation.

In order to provide better ventilation and cooling of the stator poles, the rotor disc 13 is equipped with passages 33 between its hub 31 and the bell flange 15 serving as a carrier ring for the magnet segments 14. These passages can advantageously be shaped at their edges in such a way that the access of cooling air through these passages is enhanced in the sense of a fan effect. In order to improve the cooling effect, so-called whirlers, which impart a turbulence to the cooling air in order to ensure that it has better contact with the stator windings, can still be disposed at the passages or in their proximity.

The motor in this case is constructed as an electronically commutated direct current motor. It can, however, also be constructed as a so-called switched reluctance motor. In this case, at least the flange of the rotor or its inner bearing surface is formed of a ferromagnetically relatively poorly conducting material. The assembly of the stator is comparable with that of an electronically commutated direct current motor. The advantage of the reluctance motor is in particular a construction of the rotor at more favorable costs (no expensive magnetic materials).

In order to provide better security against relative rotation between the rotor 13 and the shaft 7, the screw connection 30 of the rotor 13 at the shaft 7 can be augmented by a non-illustrated profiled shaft connection, a profiled hub connection, a fitted key connection, a conical groove connection or a keyway connection.

I claim:

1. In a front-loading washing machine having a washing liquid-container with a rear wall, an at least substantially horizontal shaft having an outer end, and a laundry drum supported overhung on the shaft, a drive device, comprising:

a flat motor mounted at the rear wall of the washing liquid container for directly driving the shaft, said flat motor having a stator connected to the rear wall of the washing liquid container, said stator having a central bearing sleeve, and said flat motor having a rotor with a peripheral portion, a bell-like flange at said peripheral portion facing the washing liquid container, a hub centrally fastened to and encompassing the outer end of the shaft, said hub supported by said central bearing sleeve, a plurality of openings between said hub and said peripheral portion, magnetizable poles distributed at said inner periphery of said bell-shaped flange, lamination stacks distributed at said stator and disposed opposite to and spaced apart from said rotor defining a minimum air gap, and exciter windings received by said lamination stacks.

2. The drive device according to claim 1, including an assembly disk mounted at the rear wall of the washing liquid container, for connecting said stator to the rear wall of the washing liquid container.

3. The drive device according to claim 1, wherein said rotor has parts constructed for enhancement of an air movement arising during rotational movement.

4. The drive device according to claim 3, wherein said rotor includes at least partially an annular stack of dynamo iron sheets and permanent magnet segments disposed thereon.

5. The drive device according to claim 1, wherein said motor is an electronically commutated direct current motor.

6. The drive device according to claim 5, wherein said lamination stacks are pole stacks of said stator formed of dynamo iron sheets and carrying coils with said exciter windings.

7. The drive device according to claim 1, wherein said motor is a switched reluctance motor.

* * * * *